US009084333B2

(12) United States Patent
Chandran et al.

(10) Patent No.: US 9,084,333 B2
(45) Date of Patent: Jul. 14, 2015

(54) SYSTEM FOR MONITORING AND CONTROLLING HIGH INTENSITY DISCHARGE (HID) LAMPS

(75) Inventors: Deepak Chandran, Pune (IN); Sanath Kumar, Pune (IN)

(73) Assignee: DEVTECH PTE LTD., Singapore (SG)

( * ) Notice: Subject to any disclaimer, the term of this patent is extended or adjusted under 35 U.S.C. 154(b) by 258 days.

(21) Appl. No.: 13/992,239

(22) PCT Filed: Aug. 3, 2011

(86) PCT No.: PCT/IN2011/000510

§ 371 (c)(1),
(2), (4) Date: Jun. 6, 2013

(87) PCT Pub. No.: WO2012/077125

PCT Pub. Date: Jun. 14, 2012

(65) Prior Publication Data

US 2013/0249397 A1 Sep. 26, 2013

(30) Foreign Application Priority Data

Dec. 8, 2010 (IN) ..... 3341/MUM/2010

(51) Int. Cl.

| | |
|---|---|
| ***H05B 37/02*** | (2006.01) |
| ***H05B 41/39*** | (2006.01) |
| ***H05B 41/392*** | (2006.01) |
| *H05B 33/08* | (2006.01) |

(52) U.S. Cl.

CPC ..... *H05B 41/39* (2013.01); *H05B 37/0263* (2013.01); *H05B 41/3928* (2013.01); *H05B 33/086* (2013.01); *H05B 33/0842* (2013.01); *H05B 33/0854* (2013.01); *H05B 37/0245* (2013.01)

(58) Field of Classification Search

None

See application file for complete search history.

(56) References Cited

U.S. PATENT DOCUMENTS

| | | | | |
|---|---|---|---|---|
| 5,471,119 | A * | 11/1995 | Ranganath et al. | 315/307 |
| 5,691,691 | A * | 11/1997 | Merwin et al. | 375/259 |
| 8,427,074 | B1 * | 4/2013 | Xiong et al. | 315/307 |
| 2003/0222603 | A1 * | 12/2003 | Mogilner et al. | 315/294 |
| 2013/0221875 | A1 * | 8/2013 | Liao et al. | 315/307 |

* cited by examiner

*Primary Examiner* — Tuan T Lam

(74) *Attorney, Agent, or Firm* — HM Law Group LLP; Vani Moodley, Esq.

(57) ABSTRACT

The present invention provides a system for monitoring and controlling high intensity discharge (HID) lamps. The system includes a digital electronic ballast integrated with PLCC modem and PLCC concentrator. The digital electronic ballast is capable of monitoring and controlling operation of each of the HID lamp in the system. The PLCC concentrator is located in AC power line network and connected to each of the digital electronic ballast connected to the respective HID lamps in AC power line network. Further, the PLCC concentrator sends the command signals such as lamp ON/OFF, lamp dimming, lamp scheduling rules to the digital electronic ballast. The PLCC concentrator also receives lamp status, real time electric parameters, failure information, end of lamp life (EOLL) or lamp burning hours, temperature conditions and warning from the digital electronic ballast thereby the PLCC concentrator provide reports to server to enable remote monitoring of the network.

3 Claims, 3 Drawing Sheets

SYSTEM FOR MONITORING AND CONTROLLING HIGH INTENSITY DISCHARGE (HID) LAMPS

FIELD OF INVENTION the present invention relates to a high intensity discharge (HID) lamps and high intensity discharge electronic ballast, more particularly, the present invention relates to a system capable of remote monitoring and controlling plurality of HID lamp by providing a HID digital electronic ballast on each of the HID lamp and with a monitoring means thereon to monitor and generate report thereof.

BACKGROUND OF INVENTION AND PRIOR ART

High-intensity discharge (HID) lighting technology is in some ways similar to that of fluorescent lamp technology. The HID lamps generally have two electrodes at either end in a closely filled gas tube. An arc is established between two electrodes in a gas-filled tube, which causes a metallic gas vapor to produce radiant energy. In fact when sufficient high voltage of 3 KV~4 KV peak to peak is applied to the electrodes, an arc is formed between them. This high voltage is termed as ignition voltage. If the lamp is hot, this voltage ranges up to 20 KV, which is termed as hot re-strike ignition voltage. Electrons in the arc stream collide with atoms of vaporized metals, shifting the wavelength of this energy into the visible range, thereby producing light without adding any phosphor coating in the inner side of the bulb. In addition, the length of the electrodes is only few inches and the gases in the tube are highly pressurized. The arc generates extremely high temperatures, causing vaporization of metallic elements in the gaseous atmosphere and the release of massive amounts of visible radiant energy. There are three primary types of HID lamps: a mercury vapour lamp, a sodium lamp and a metal halide or a ceramic metal halide. The nomenclature of the above lamps refers to the elements that are added to the gases in the arc stream, which cause each type to have somewhat different colour characteristics and overall lamp efficiency. These lamps are used extensively, as they are efficient and have a high brightness output. Mercury vapour lamp lighting is the oldest HID technology. The mercury vapor lamp produces a bluish light that renders colours poorly. Therefore, most of the mercury vapour lamps have phosphor coating that alters the colour temperature and improves colour rendering to same extent. Although, these are not the most efficient HID lamps, these were often used because of their longer lifetime with respect to the other types of the HID lamps. Concerning sodium lamps, high-pressure sodium sources were developed primarily for their energy efficiency.

Further, mercury and sodium vapours in the ceramic arc tube produce a yellow/orange light with extremely high LPW (Lumen per Watt) performance and exceptionally long service life (up to 40,000 hours). High-pressure sodium lamps render colours poorly, which tends to limit their use to outdoor and industrial applications where high efficacy and long life are priorities. Metal halide lamps or ceramic metal halide lamps are among the most energy efficient sources of white light available today. These lamps feature special chemical compounds known as "halides" that produce light in most regions of the spectrum. They offer high efficacy, excellent colour rendition, long service life, and good lumen maintenance. Because of their advantages, metal halide lamps are used extensively in outdoor applications and in commercial interiors.

The HID lighting system deliver a high brightness output and are typically used in large retail stores, industrial buildings, shopping malls, and studios ceiling lighting. The HID lighting system is most commonly use for parking lots and street lighting. New applications include automotive headlamps; front projection for meeting rooms and rear projection (DLP TV's) are also now using the HID lighting system. The HID systems consist of high pressure sodium (HPS) lighting systems as well as metal halide lighting systems (MH) or advanced ceramic metal halide lighting system (CMH).

The HID lamps have unique electrical characteristics and require a careful and specific control method, so these HID lamps must require a HID ballast circuitry or choke to properly supply the lamps themselves. The HID ballasts are an integral part of high intensity density discharge (HID) lighting system. The HID ballast regulates the flow of electrical current to the HID lamp to maintain its steady operation. The HID lamps require a high voltage for ignition, typically 3 kV to 4 kV, but more than 20 kV if the lamp is hot. Therefore, the HID ballast component should provide the sufficient ignition voltage for the arc generation, which is not provided by these HID ballast. Before ignition, the HID lamp is in open circuit. After the HID lamp ignites, the lamp voltage drops quickly from the open-circuit voltage to a very low value—typically 20 V—due to the low resistance of the HID lamp. If otherwise unimpeded, this characteristic causes the lamp current to increase to a high value; therefore, the HID ballast must limit the lamp current to a safe maximum level, which is not provided by these HID ballast. As the lamp warms up, the current decreases as the voltage and power increase. Eventually, the lamp voltage reaches its nominal value, typically 100 V, and the ballast regulates the power to the correct level.

Many high intensity discharge lighting systems incorporate or are traditionally powered by standard conventional type electro-magnetic HID ballast, which operates with a basic copper core/coil transformer, capacitor for power factor correction and igniter for the ignition. These components simply start and maintain the lamp operating functions.

However, the present electromagnetic ballast exhibits following has disadvantages:

(a) Low efficiency because of internal high KVAR reactive or inductive losses due to copper winding resistance and iron core losses;
(b) Low power factor, High total harmonic distortion (THD);
(c) Are susceptible to incoming voltage fluctuations thereby causing large lamp power and brightness variation;
(d) Have a hard initial start up which degrade the life expectancy of the lamp;
(e) Generally cannot be dimmed;
(f) Physically heavy weight and large size making them difficult to install in aerial situations;
(g) Have many wires to interconnect which complicates their installation;
(h) More noisy with age;
(i) operated at relatively high temperatures;
(j) Can be damaged by power surges; and
(k) Faster aging.

Many of the prior art based intelligent light network management uses a radio frequency (RF) based wireless control technologies for the remote monitor and control of each HID lamp. Here Radio Frequency (RF) modem is integrated within the Electronic Ballast, which uses the radio waves as the communication media. Through the use of mesh (repeater-based) RF networking and new protocols, these technologies are purported to offer the performance of twisted pair solutions but offers very poor robustness against sources of interference, very limited distance operation, mediocre battery performance, and in one case, response times slower than sneaker net. The underlying RF modems used within these control networks are made by, or the technology is sourced from, a common pool of semiconductor manufacturers. The RF technology of the prior art share many common underlying elements and limitations. For example, all of these systems use mesh networking, in which RF-based devices can also operate as repeaters, to compensate for the poor distance of their radio. The strength of an RF signals drops 6 dB for every incremental doubling of open field distance with no impairments or obstacles. The presence of typical building construction materials such as gypsum panels, metal-foil wall paper, aluminum wall braces, and office or factory equipment further reduces RF signal strength. An RF signal drops inside a typical building with obstacles/impairments by about 25 dB for every incremental doubling of distance. None of the RF mesh networks would work in such environment.

Further, the RF signalling is regulated by national governments; all of the RF technology suppliers must share their assigned RF frequency spectrum that's in common with other authorized RF-based devices and systems. The devices that share the 868 MHz (Europe), 915 MHz (United States), 865 MHz (India), 433 Mhz (china) and ISM 2.4 GHz bands that unlicensed, mesh network-based control networks operate on include 802.11 (Wi-Fi) routers and network interfaces, cordless phones, Bluetooth devices, audio and video extenders, closed circuit television transmitters, and other control networking devices. The interference between different wireless devices reduces reliable communication between any two devices. Various RF technologies use different techniques to mitigate interference caused by other devices in their space. For example, 802.11 (Wi-Fi) and Zig-Bee uses Direct Sequence Spread Spectrum (DSSS) to distribute the information over a wider bandwidth, while Bluetooth uses Frequency Hopping Spread Spectrum (FHSS) to randomly move from channel to channel. Cordless phones based on both DSSS and FHSS are available on the market. Interference among multiple DSSS devices operating in adjacent bands poses a problem due to overlapping caused by spectral re-growth of the frequency bands. The net result, compounded by shared use of a limited frequency range, is reduced system performance and reliability. The growing number of RF devices operating within the shared frequency bands is creating virtual RF traffic jams, and a corresponding degradation in reliability. The downside of RF is that it's hard to penetrate metal building materials; the allowable frequency bands are increasingly crowded and therefore, subject to interference; and bidirectional RF devices requires either multiple receivers or repeaters to propagate a reasonable distance.

PRIOR ART

U.S. Pat. No. 4,717,863 relates to an oscillator circuit, which generates a frequency modulated square wave output signal to vary the frequency of the power supplied to a circuit.

Yet another arrangement is shown in U.S. Pat. No. 5,041, 767, which relates to gas discharge system controlled in intensity and in the length along a tube that is illuminated by providing digital control signals to an analog drive circuit connected to the high voltage-energising device for the tube.

Yet another arrangement is shown in U.S. Pat. No. 5,612, 597 relates to a circuit and method for driving a load such as a gas discharge illumination device from an AC main supply with a high power factor. The circuit includes a pair of electronic switches arranged in the half bridge configuration and self-oscillating driver push-pull circuit having two outputs for driving respective ones of the electronic switches, the electronic switches being coupled across an AC bus voltage and having a switched output coupled to the load.

One more arrangement is shown in India application no. 00635/KOL/2003 relates to self oscillated resonant mode power MOSFET based HID Electronics ballast with full bridge-isolated drive inverter from a DC voltage supply, may be a PPEC/APFC based, with ignition & short circuit protection circuit, frequency controlled, established power to drive simple/multi higher watt HID lamps.

Yet another arrangement is shown in U.S. Pat. No. 6,259, 215 relates to a circuit with the micro-processor controlled high frequency electronic ballast for gas discharge lamps in which the dimming is accomplished by varying the frequency of the square wave generated by the ballast. Prior to ignition, the ballast generates a high frequency square wave to preheat the lamp filament. The microprocessor, which is programmable, controls the operating and preheating frequencies of the ballast. Therefore, this arrangement uses the high frequency to operate the lamps. Electronic circuits supplying HID lamps made use of microcontrollers and complicated topologies to regulate and control the light output. This complex solution typically requires more control ICs, algorithms and BOM components resulting in a high component count, large area of PCB board space, high manufacturing costs, and high overall ballast cost and non serviceable in case any issues occurs related to components. Generally four power switches are used in full-bridge topology, two of which work at high frequency (80 kHz-100 kHz) in order to regulate the lamp current, while the other two work at low frequency (150 Hz-400 Hz). Electronic ballasted fluorescent lamps are typically operated at these high frequencies of 30-100 KHz. HID lamps have been operated at these frequencies also, but acoustic resonance often occurs which can cause damage to the lamp due to arcing instability, fluctuation in light lumen output and often even cause the cracking of tubes and worst case lamp to explode. As a result, the HID lamps are typically operated at lower frequency square wave in the few 100 Hz range (100 Hz to 800 Hz) to avoid acoustic resonance. At these low frequencies, larger full bridge-switching circuits are employed to drive the HID lamp with a square wave without resonant output circuits. In addition, it must be ensured that the ripple current is well below 20% to prevent the acoustic resonance in a low-frequency square wave operation. Since, each HID lamp types have different characteristics, as this does not have auto sensing lamp circuitry/algorithms (which can sense the different lamp characteristics and functions accordingly) the same arrangement cannot be used to operate all types of lamps.

In addition, one of the major problems in lighting electronics of all the prior art is the starting or igniting of the lamp. The HID lamps need a starting voltage of sufficient amplitude and appropriate rise and width time in order to start properly. The HID electronic ballast of the prior arts uses resonant based electronic inverters, which has the ignition capability if they are designed properly. But, if the inverter has no capability of providing this starting voltage, an external igniter must be used during the starting of the lamp. If the inverter of the lamp ballast is a resonant tank, two basic solutions found in the prior art for starting the lamp. By using a single resonant tank, changing the operating frequency in order to provide proper operation during start-up and steady state, and by using a relay to switch between two different resonant tanks, one for start-up, and another for steady-state operation.

The main drawback of the first approach is the high stresses in reactive elements during start-up, leading to higher ballast cost and volume. The second approach allows a better optimization of reactive elements, but circuitry complexity increases. Besides, the use of relays decreases the circuit reliability. If the inverter of the lamp ballast is a non resonant one, an auxiliary external igniter is needed. The HID lamps of the prior art are typically ignited with a single pulse starter, also leading to reliability problems, as the lamps may fail to strike with such single pulse igniters. Further, when the HID lamps are hot, the ignition voltage rises to much higher levels, for example, approximately about 25 kilovolts.

Therefore, above-mentioned characteristics are required for ballasts of fluorescent lamp which may work on resonant based topology that are differs from the requirement for the HID lamps. The solutions provided in the prior art are complex and typically requires more control ICs and BOM components resulting in a high component count, large area of PCB board space, high manufacturing costs, and high overall ballast cost and non serviceable in case of component problems and hence termed as non serviceable product. Even by adding more functionality to it, the overall cost of the ballast increases drastically. Some prior art electronic ballasts have inadequately shielded reflector cables resulting in RF interference.

OBJECTS OF THE INVENTION

Object of the present invention is to provide a system for monitoring and controlling high intensity discharge (HID) lamps, which provides improved methods and protection circuits for controlling the HID lamp, which overcome all the drawbacks of prior art.

Another object of the present invention is to provide a system for monitoring and controlling HID lamps, which is capable of protecting the HID ballast and lamp from high power surges and lightning strikes, and also, capable of blocking ballast generated noise from being transmitted back on to power lines.

Yet another object of the present invention is to provide a system for monitoring and controlling HID lamps, which boosts power factor correction (PFC) circuitry for operating over entire 440 VAC range for boosting the voltage from the said rectified DC output to be supplied with VBUS 650 VDC, and to maintain the constant DC bus voltage regulation under constant power control to the HID lamp.

Further object of the present invention is to provide a system for monitoring and controlling HID lamps, which permits power factor (PF) near to unity power factor, and low harmonic distortion and for over voltage protection up to 440 VAC operating range without cut-off.

Further one object of the present invention is to provide a system for monitoring and controlling HID lamps, which is capable of sensing different lamp type characteristics and functions to operate the HID lamp accordingly.

Another object of the present invention is to provide a system for monitoring and controlling HID lamps, which can be used with various lamp types having different power levels such as 35 W, 70 W, 150 W, 250 W, 400 W, 600 W, and 1000 W.

Yet another object of the present invention is to provide a system for monitoring and controlling HID lamps, which is capable of detecting failure and end of lamp life (EOLL) thereby protect the ballast against conditions such as lamp strike failures, low DC bus level, thermal overload or lamp failure during normal operation.

One more object of the present invention is to provide a system for monitoring and controlling HID lamps, which is capable of remotely monitoring and controlling the HID lamps through existing power lines as the communication media without any other structural changes for making the lamp ON/OFF, dimming, to know the lamp status, to set the scheduling rules, to know the real time electric parameters, to know the failure information, end of lamp life (EOLL) or lamp burning hours based on which maintenance operator can anticipate the lamp change operations.

One more object of the present invention is to provide a system for monitoring and controlling HID lamps, which is capable of operating the HID lamp at lower frequency square wave in the few 100 Hz range (100 Hz to 800 Hz) to avoid acoustic resonance problems.

Further object of the present invention is to provide a system for monitoring and controlling HID lamps, which is capable of automatically detecting the failure conditions and notifies the users with the condition or health of the ballast and HID lamp, thereby saving considerably amount of energy and also offer additional advantages at enterprise user level.

Further one object of the present invention is to provide a system for monitoring and controlling HID lamps, which is capable of measuring the real time electrical parameters and total cumulative energy consumed.

One more object of the present invention is to provide a system for monitoring and controlling HID lamps, more elegant cost effective solution desired for integrating as many functions as possible into a single module to reduce component count, reduce PCB board space, reduce manufacturing costs, reduce overall ballast cost than the conventional type electro-magnetic HID ballast system and, and increase its reliability.

Other features and advantages of the present invention will become apparent from the following detailed description of embodiments of invention.

SUMMARY OF THE INVENTION

According to the present invention there is provided a system for monitoring and controlling a high intensity discharge (HID) lamps, the system comprising a digital electronic ballast for monitoring and controlling each of HID lamp, the digital electronic ballast comprising:

an energy measuring Application-Specific Integrated Circuit (ASIC) module receiving electricity form a power source, wherein the energy measuring ASIC module means is capable of measuring electricity line voltage, current, active power, reactive power, apparent power, power factor (PF) and total power unit consumption of the digital electronic ballast and HID lamp connected thereto, a fuse electrically connected to a neutral output of the energy metering ASIC module, the fuse breaks the electricity supply during short circuit, overload and device failure thereby protects the digital electronic ballast from damaging, a surge and lightning protection circuit electrically connected to energy measuring output means through the fuse there between, the surge and lightning protection circuit provides protection from high voltage line surges, inrush current and lightning strikes, an Electromagnetic interference (EMI) filter electrically connected to the surge and lightning protection circuit, the EMI filter filters noise generated by the digital electronic ballast from transmitting reverse back on to an electricity supply lines, filters out harmonics for an incoming ranging from 90 to 440 volts having alternating current of 50 to 60 hertz cycle and acts as high impedance path to attenuate the high frequency signal, and reduces strength of the signal thereby reducing adverse effect on the device, a full wave bridge rectifier electrically connected to the EMI filter, the full wave bridge rectifier converts electricity having alternating current (AC) received from the EMI filter to direct current (DC) thereby providing high voltage bus power, the converted DC output from the full wave bridge rectifier is provided to reservoir filter capacitor (or smoothing capacitor) to reduce the variation in (or 'smooth') the rectified AC output voltage waveform from the bridge, a power factor correction (PFC) booster electrically connected to the full wave bridge rectifier, the PFC booster boosts the voltage received from the full wave bridge rectifier and maintains a sinusoidal current that is in phase with AC supply line input to attain the high power factor and low harmonic distortion and regulates constant DC bus voltage ranging from 400 VDC to 650 VDC electricity to the rest of the circuit elements even if the incoming AC electricity fluctuates anywhere between 90 VAC to 440 VAC, where the PFC booster circuit is bypassed at Vbus>Vin*sqrt(2) and operates over entire high voltage range till 440 VAC input voltage without any cut-off, a DC-DC buck circuit electrically connected to the PFC booster, the DC-DC buck circuit receives the constant DC bus voltage from the PFC booster, wherein the DC-DC buck circuit controls the amount of current delivers to the HID lamp while warming up and during running state, a full-bridge circuit with a Silicon diode for Alternating Current (SIDAC) ignition switch electrically connected to the DC-DC buck circuit, wherein the full-bridge circuit enables driving of the HID lamp with a low frequency square wave voltage and the SIDAC ignition switch enables the striking of the HID lamp connected thereof, a lamp feedback member is electrically connected to the full-bridge circuit, the lamp feedback member senses the HID lamp voltage and current, and provide the feedback signals thereof for sensing HID lamp characteristics, and controlling working thereof, the lamp feedback member comprises an ISENSE for current sense which senses the lamp current signals and a VSENSE for voltage sense which senses lamp voltage signals, an application-Specific Integrated Circuit (ASIC) control card connected to the PFC booster, the DC-DC buck circuit, the full-bridge circuit and the SIDAC ignition switch, wherein the ASIC control card receives feedback signals from the HID lamp feedback member thereafter controls the operation of the PFC booster, the DC-DC buck circuit, the full-bridge circuit and the SIDAC ignition switch depending upon surrounding environmental parameters and characteristics sensed around the HID lamp thereby the ASIC control card controls working of the HID lamp, an auxiliary power supply electrically connected to an output of the PFC booster, the auxiliary power supply receives the constant DC bus high voltage of about 600 to 700 VDC from the PFC booster and converts into low voltage DC bus in the range of 15 to 20 VDC to give the supply voltage to power up the ASIC control card;

a Power-line Carrier Communication (PLCC) modem electrically connected between the surge and lightning protection circuit, the EMI filter and the energy measuring ASIC module for remote monitoring and control operation of the HID lamp, wherein the PLCC modem receives measuring line voltage, line current, active power, reactive power, apparent power, power factor and total power unit consumption of the HID lamp from the energy measuring ASIC module, a temperature sensor for sensing and measuring temperature of the ballast and surrounding thereof, and provide feedback data signal to the PLCC modem to check for high and low temperature alarm conditions to operate the ballast to ON/OFF when the temperature exceeds or less than normal operating temperature, and an ambient light sensor connected to the PLCC modem, the ambient light sensor capable of measuring brightness of the ambient light source or available light source in a manner similar to human eye and gives the feedback data signal to the PLCC modem to adjust based on ambient light conditions during the twilight conditions (time between dawn and sunrise, and between sunset and dusk), cloudy conditions, low lux level conditions to ON/OFF the HID lamp by sending HID ON/OFF control signal to the ASIC control card (16), and for dimming the HID lamp to set different brightness levels by sending the 10 KHz Pulse width modulation (PWM) signal with variable duty cycle to the ASIC control card; and a PLCC concentrator is located in an AC power line network and connected to the PLCC modem of each of the digital electronic ballast connected to the respective HID lamps in the AC power line network, the PLCC concentrator sends the command signals such as lamp ON/OFF, lamp dimming, lamp scheduling rules to the PLCC modem, also receives lamp status, real time electric parameters, failure information, end of lamp life (EOLL) or lamp burning hours, temperature conditions and warning from the PLLC modem thereby the PLCC concentrator provide reports to a server to enable remote monitoring of the network.

BRIEF DESCRIPTION OF DRAWINGS

The advantages and features of the present invention will become better understood with reference to the following detailed description and claims taken in conjunction with the accompanying drawings, wherein like elements are identified with like symbols, and in which:

DETAILED DESCRIPTION OF THE INVENTION

Figure 1:
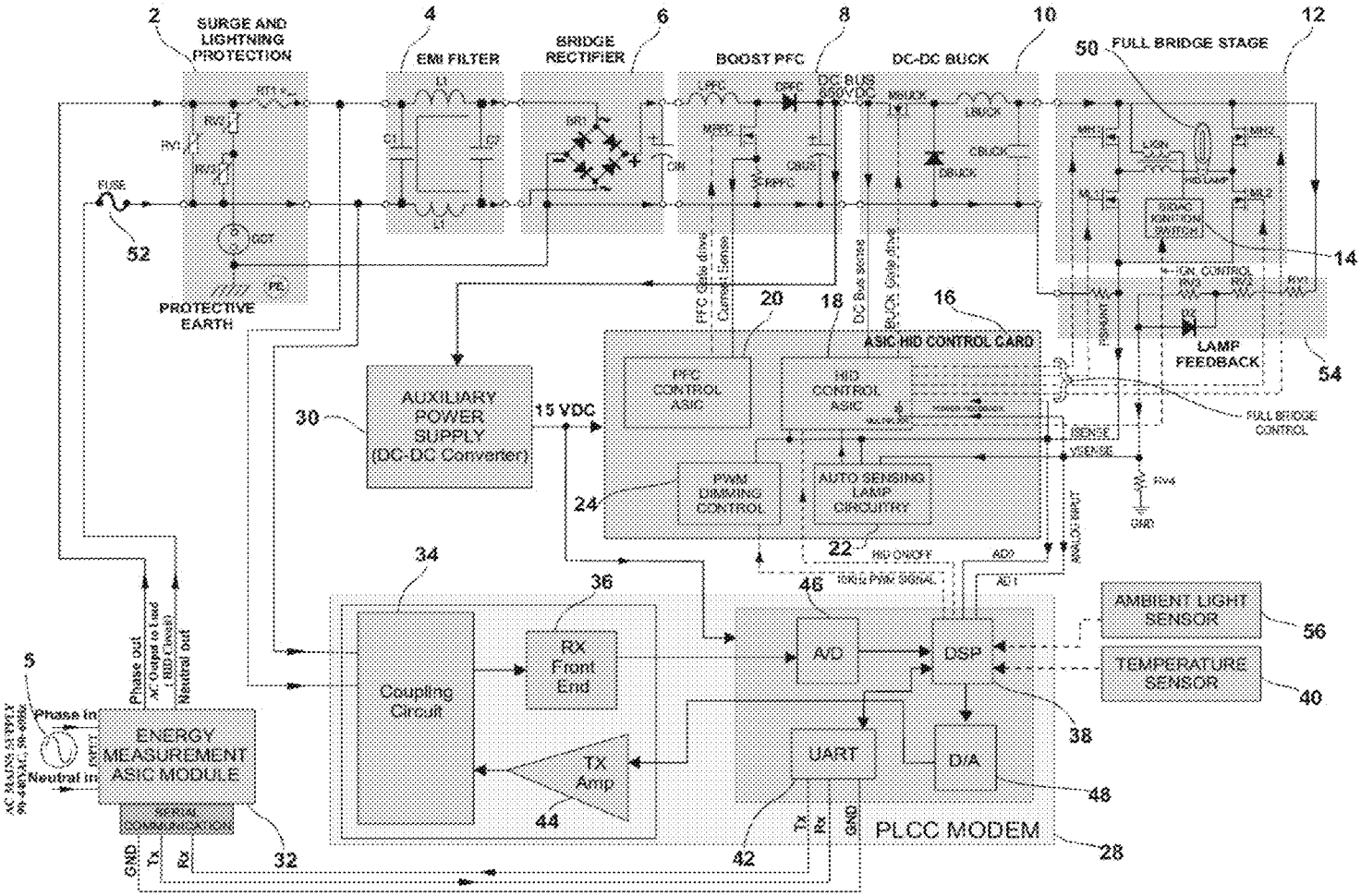
FIG. 1 shows a block diagram of digital electronic ballast, which lists the main essential elements in accordance with the present invention.

In the description, which follows, like parts are marked throughout the specification and the drawings with the same respective reference numerals in brackets. The drawings are not necessarily to scale and in some instances, proportions may have been exaggerated in order to more clearly depict certain features of the invention. Like parts contain like numbers throughout the figures.

The present invention provides a system for monitoring and controlling HID lamps includes a digital electronic ballast.

Referring now to FIG. 1, the digital electronic ballast (herein after referred as ballast) in accordance with the present invention is illustrated. The ballast includes an energy measurement Application-Specific Integrated Circuit (ASIC) module (32), a fuse (52), a surge and lightning protection circuit (2), an Electro Magnetic Interference (EMI) filter (4), a full wave bridge rectifier (6), a Power Factor Correction (PFC) booster (8), a DC-DC buck circuit (10), a full-bridge circuit (12), a Silicon diode for alternating current (SIDAC) ignition switch (14), a Application-Specific Integrated Circuit (ASIC) HID control card (16), a PLCC (Power-line Carrier Communication) modem (28), an auxiliary power supply (30), a temperature sensor (40), a HID lamp (50), a lamp feedback member (54) and an ambient light sensor (56).

The energy measurement ASIC module (32) receiving electricity (AC input in range of 90 VAC~440 VAC) from a power source, such as electricity from a grid, a transformer, and the like through an Alternating Current (AC) supply connection (5). The energy measuring ASIC module (32) is capable of measuring parameters, such as electricity line voltage, current, active power in KiloWatts—Kw, reactive power in kilovolt ampere reactive—KVAR, apparent power Kilovolt Ampere—KVA, power factor (PF) and total power unit consumption (Kilowatt hour) of the ballast and HID lamp (50) connected thereto the ballast. The energy measurement ASIC module (32) measures the above parameters when there is supply of electricity through the electricity line. The electricity line refers to the main wire carrying electricity from the power line.

Further, the fuse (52) is electrically connected a neutral output electricity line of the energy metering ASIC module (32), which is connected to the surge and lightning protection circuit (2). The fuse (52) is capable of breaking the electricity supply further from the energy metering ASIC module (32) to the ballast during short circuit, overloading, and device failure, thereby protecting the ballast. The fuse (52) is made of metal wire or strip that melts when excess current flows therethrough because of short circuit, overload or device failure, thereby interrupting or breaks the electricity supply. The surge and lightning protection circuit (2) provides protection from high voltage in the electricity line surges, inrush current and lightning strikes thereon, thereby protecting the ballast from various damages.

Referring again to FIG. 1, the EMI filter (4) is electrically connected to the surge and lightning protection circuit (2). The EMI filter (4) filters noise generated by the ballast from transmitting reverse back on to the electricity lines. The EMI filter (4) also, filters out harmonics (sound) for electricity lines in an incoming ranging from 90 to 440 volts having alternating current of 50 to 60 hertz cycle and acts as high impedance path to attenuate the high frequency signal. Further, the EMI filter (4) reduces strength/concentration of the signal thereby reducing adverse effect on the ballast. The full wave bridge rectifier (6) is electrically connected to the EMI filter (4). In an embodiment, the EMI filter (4) comprises a cascade inductive capacitive (LC) Filter L1, C1, and C2, where capacitive and inductive elements are cascaded together.

Further, the full wave bridge rectifier (6) receives electricity from the EMI filter (4). The full wave bridge rectifier (6) is capable of converting electricity having alternating current (AC) received from the EMI filter (4) to direct current (DC) thereby providing high voltage bus power. The converted DC electricity output from the full wave bridge rectifier (6) is provided to reservoir filter capacitor or smoothing capacitor CIN (not numbered) to reduce the variation in (or 'smooth') the rectified AC output voltage waveform received from the EMI filter (4). The full wave bridge rectifier (6) is electrically connected to the PFC booster (8) through the electric line. The full wave bridge rectifier (6) is an arrangement of four diodes in a bridge configuration set up as a standard full wave bridge rectifier to rectify the AC current to a DC current thus provides the high voltage bus power.

In an embodiment, High voltage protection above 240 VAC for the ballast circuitry is achieved by setting the PFC DC bus output voltage higher than Vin*sqrt(2), where the boost PFC circuit (8) is bypassed at Vbus>Vin*sqrt(2) and operates over entire high voltage range till 440 VAC input voltage without any cut-off in circuit. Here the PFC bus DC bus voltage is set to 650 VDC and failures usually at the hysteresis Point where the boost is bypassed at Vbus>VIN*sqrt (2). This arrangement use the MOSFET switch MPFC and boost diode DPFC with the voltage rating 120% of DC bus voltage or 1.2 times DC bus voltage and current rating 3 times the DC output current and the boost cap or storage capacitor CBUS with 650 VDC rating or use 2 Capacitors of 350 VDC in series connection to maintain the constant DC bus voltage 650 VDC and the proper selection of resistive divider connection between boost regulated output voltage and IC1 biasing circuitry INV pin. The internal reference on the non-inverting input of a error amplifier is 2.5V typical while dynamic trigger current intervention is 27 uA typical. The resistor divider is selected using the following equations.

$$\frac{R_{outH}}{R_{outL}} = \frac{V_{out}}{2.5} - 1$$

$$R_{outH} = \frac{\Delta V_{OVP}}{27\ \mu A}$$

where RoutH is the upper resistor RoutL is the lower one, and ΔVOVP is the overvoltage threshold.

The PFC booster (8) boosts the voltage of the electricity received from the full wave bridge rectifier (6) and maintains a sinusoidal current that is in phase with AC supply line input to attain the high power factor (PF) and low harmonic distortion and regulates constant DC bus voltage ranging from 400 VDC to 650 VDC electricity to the rest of the circuit elements. Further, even if the incoming AC electricity fluctuates anywhere between 90 VAC to 440 VAC, a high voltage protection above 220 to 260 VAC for the digital electronic ballast circuitry is done by setting a PFC DC bus output voltage higher than Vin*sqrt(2), where the PFC booster (8) is bypassed at Vbus>Vin*sqrt(2) and operates over entire high voltage range till 440 VAC input voltage without any cut-off. Further, The PFC booster (8) connected to the ASIC control card (16). The ASIC control card (16) controls the operation of the PFC booster (8). Further, the PFC booster (8) is electrically connected to the DC-DC buck circuit (10) through the power line.

The DC-DC buck circuit (10) receives the constant DC bus voltage from the PFC booster (8). Further, the DC-DC buck circuit (10) controls the amount of current delivers to the HID lamp (50) while warming up and during running state. The DC-DC buck circuit (10) is connected to the ASIC control card (16) and working of the DC-DC buck circuit (10) is controlled by the ASIC control card (16). Further, the DC-DC buck circuit (10) is electrically connected to the full-bridge circuit (12) and with the SIDAC ignition switch (14). When the HID lamp (50) is running, the HID controller ASIC (18) receives the signals from the lamp feedback member (54) and controls the buck circuit (10) on-time to keep the multiplier output equal to a reference voltage and thereby regulate the HID lamp (50) output (power) to constant level.

The full-bridge circuit (12) and the SIDAC ignition switch (14) are electrically connected to the DC-DC buck circuit (10). The full-bridge circuit (12) enables driving of the HID lamp (50) with a low frequency square wave voltage and the SIDAC ignition switch (14) enables the striking of the HID lamp (50) connected thereof. Further, the full-bridge circuit (12) is electrically connected to the lamp feedback member (54).

The lamp feedback member (54) is capable of sensing voltage and current of the HID lamp (50), and provide the feedback signals thereof to the ASIC control card (16) to provide condition (characteristics) of the HID lamp (50). Further, the ASIC control card (16) controls working of the HID lamp (50) depending upon the inputs of the lamp feedback member (54). The lamp feedback member (54) also includes an ISENSE for current sense which senses the lamp current signals and VSENSE for voltage sense which senses the lamp voltage signals.

Referring again to FIG. 1, the ASIC HID control card (16) is connected to the PFC booster (8); the DC-DC buck circuit (10), the full-bridge circuit (12) and the SIDAC ignition switch (14). The ASIC HID control card (16) receives feedback signals from the lamp feedback member (54) depending up the signals received the PFC booster (8), the DC-DC buck circuit (10), the full-bridge circuit (12) and the SIDAC ignition switch (14) depending upon surrounding environmental parameters and conditions (characteristics) sensed around the HID lamp (50), the ASIC HID control card (16) controls working of the HID lamp (50).

Further, the ASIC HID control card (16) includes a PFC controller ASIC (20), a HID controller ASIC (18), an autosensing lamp circuitry (22), a Pulse width modulation (PWM) dimming controller (24). The PFC controller ASIC (20) is electrically connected to the PFC booster (8). The PFC controller (20) controls the PFC booster (8) to operate either in a fixed frequency (FF) average current mode PWM or a transition mode (TM) PWM-fixed ON time, variable frequency to maintain the high power factor, low harmonic distortion, constant lamp output voltage even if incoming power source fluctuate anywhere between 90~440 VAC, to power up the PFC controller ASIC (20) receives the 15 VDC supply voltage from auxiliary power supply.

Specifically, the HID controller ASIC (18) is electrically connected to the DC-DC buck circuit (10). The HID controller ASIC (18) provides control signals to the full-bridge circuit (12), the SIDAC ignition switch (14) based on feedback signals from the lamp feedback member (54) and completely controls of the HID lamp (50) ignition, warm-up, running and all fault modes. Further, the HID controller ASIC (18) controls the DC-DC buck circuit (10), which operate in either critical-conduction mode or continuous-conduction mode depending on changing load conditions. Furthermore, the HID controller ASIC (18) receives the signals from lamp feedback member (54) to control the buck on-time to keep the multiplier output equal to an internal reference voltage and thereby regulate the HID lamp (50) power to a constant level. The HID lamp (50) current limitation feedback circuitry to control the buck on-time to limit the lamp current sensing input to an internal reference voltage and thereby limit the maximum allowable lamp current level. Also, the HID controller ASIC (18) includes fault detection logic to detect non-strike, under-voltage, and end-of-life lamp fault conditions, safely shut the ballast off should any of these fault conditions occur, fault counter for counting number of fault occurrences (typically>10,000 events) of a fault occurrence before deactivating the ballast, programmable fault clock for measuring the elapsed time (typically>5 minutes) of a fault occurrence before deactivating the ballast, good fault counter for resetting the fault counter should a period of time (typically>1 hour) elapse where no faults have been detected, senses the feedback input from autosensing lamp circuitry and operate the HID lamp (50) accordingly, senses the DC offset input from PWM dimming circuitry (24) to provide the step dimming function from 1-100% to set the different lamp brightness levels, senses the HID lamp (50) ON/OFF control signal from the DSP (38) and accordingly controls the HID lamp (50) for ON and OFF, to power up it receives the 15 VDC supply voltage from auxiliary power supply (DC-DC converter);

The autosensing lamp circuitry (22) provides feedback to the HID controller ASIC (18), the autosensing lamp circuitry is an analog comparator logic circuitry electrically connected to the lamp feedback member (54), which senses the different characteristics (current and voltage) of the HID lamp (50) and gives the feedback input to the HID control ASIC (18) to operate the HID lamp (50) accordingly.

The PWM dimming controller (24) provides feedback to the HID controller ASIC, the PWM dimming controller is an analog circuit electrically connected to the ISENSE of the lamp feedback member (54) and receives the 10 Khz, 5V PWM (Pulse width modulation) input signal based on the HID lamp (50) dimming command signals received from the PLCC module (28) and based on ambient light measured from the ambient light sensor and the PWM dimming controller (24) adds the DC offset to the ISENSE input of the HID control ASIC (18) to control and set the brightness of the HID lamp (50) from 1-100% thereby saving considerably amount of energy.

The ballast includes the auxiliary power supply (30). The auxiliary power supply (30) is electrically connected to an output of the PFC booster (8). The auxiliary power supply (30) receives the constant DC bus high voltage of about 600 to 700 VDC from the PFC booster (8) and converts the same into low voltage DC bus in the range of 15 to 20 VDC to give the supply voltage to power up the ASIC control card (16).

Further, the PLCC modem (28) is electrically connected between the surge and lightning protection circuit (2), the EMI filter (4) and the energy measuring ASIC module (32) for remote monitoring and control operation of the HID lamp (50). The PLCC modem (28) receives measuring line voltage, line current, active power (KW), reactive power (KVAR), apparent power (KVA), power factor (PF) and total power unit consumption (Kilowatt hour) of the HID lamp (50) from the energy measuring ASIC module (32).

Further, the PLCC modem (28) includes a coupling circuit (34), a Receiver (Rx) front end (36), a Transmitter (TX) Amplifier (44), an Analog to Digital (A/D) converter (46), a Digital to Analog (D/A) converter (48), a digital signal processing (DSP) (38), an Universal Asynchronous Receiver Transmitter (UART) (42) with serial communication interface (GND, TX, RX).

The remote monitoring and control system for the HID lamps (50) is provided by integrating the PLCC modem (28) within the ballast which uses existing power lines as the communication media with FSK/BPSK/OFDM modulation techniques, thereby remotely allowing turn on and off the HID lamp (50), control the illumination, scheduling, monitoring of energy parameters, operational states of the HID lamps (50), and failure information. A PLCC (Power Line Carrier Communication) systems have been in use for several decades, attempting to bring greater bandwidth and services to user, to compete with other communications technologies. The PLCC technologies have provided systems that include a plurality of communications network. These modems are in general setup to facilitate communications, and may be updated using hardware and software to modify their features and possibility to operate. The existing power distribution systems can be used to provide data communication in addition to power delivery, which obviates any structural changes.

In other words, existing power lines that already have been run to many homes, offices and outdoor areas, has been used to carry data signals. Power lines are designed to carry the power and not the data. This means it takes a very sophisticated transceiver to reliably communicate over power lines. Many electrical devices connected to the power lines adversely impact the data that is being transmitted. The quality of the signal that is transmitted over power lines is dependent on the number and type of the electrical devices (televisions, computers, hair dryers, etc.) connected to the power lines and switched on at any given time.

Further, the quality of the signal is also dependent upon the wiring distance (not physical distance) between the transmitter and the receiver as well as the topology (wiring architecture) of the power line infrastructure in the home/building. All of the above impediments could vary between buildings, neighbourhoods, and the power grids in various countries, making a universal solution even more challenging. There is a regulation limit for the amount of radiated energy of power line communication system, which therefore limits the strength of the data signal that can be injected on to power lines. Consequently, due to attenuation of power lines, communications signal typically travels only a relatively shorter distance on power line. In addition, the travel distance may vary from location to location.

The PLCC modem (28) receives command signals, such as the HID lamp (50) ON/OFF, dimming, lamp status, scheduling rules, real time electric parameters, failure information's, end of lamp life (EOLL) or the HID lamp (50) burning hours from the PLCC concentrator located in AC power line network through AC power line media and the PLCC modem (28) processes the received command request by sensing the feedback input signals from the lamp feedback stage (54), the temperature sensor (40), the ambient light sensor (56) and provides the control signals to ASIC HID control card (16) for operating the HID lamp (50) to ON/OFF. The PWM dimming control (24) of 10 KHz enables to set different lamp brightness levels and receiving the meter reading from the Energy measurement ASIC module (32) serial UART communication (GND, TX, RX) and sends the response back to the PLCC concentrator. It receives the 15 VDC supply voltage from auxiliary power supply (DC-DC converter) to power up the DSP (38), the A/D converter (46), and the D/A converter (48) thereby capable of remotely monitoring and controlling the ballast through existing power lines as the communication media without any other structural changes such as Frequency Shift Keying (FSK)/Binary Phase Shift Keying (BPSK)/Orthogonal Frequency Division Multiplexing (OFDM).

The coupling circuit (34) is electrically connected between the surge and lightning protection circuit (2) and the EMI filter (4), which attenuates the large AC mains signal (at either 50 Hz or 60 Hz), while passing the communication data signal to the TX Amplifier (44) and a RX front end (36) of the PLCC modem (28) thereof. The coupling circuit (34) provides a coupling between the power line of the ballast and the PLCC modem (28). The coupling circuit (34) includes a coupling capacitor and an inductor or transformer, which provides a high-pass filter for receiving and transmitting the signal and attenuates the signal of frequency lower than its cut-off frequency.

Further, the RX front end (36) is a discrete interface circuitry, which is electrically connected to the coupling circuit (34) to provide the filtered analog output to the A/D converter (46) for converting signals from analog to digital for digitization of signal. The mains coupling circuit (34) removes the majority of the 50/60 Hz line voltage and provides the received communication signal to the RX front end (36). The RX front end (36) has third order high-pass filter discrete circuit, which receives the signal from mains coupling circuit (34) and provides the initial filtering of high frequency noise that is below the communication frequencies used by DSP (38) and also form a soft limiter to limit the amplitude of large signals that pass through the high and low-pass filters.

The A/D converter (46) is electrically connected to the RX front end (36) and converts a filtered analog data output received from Rx front end (36) to digital data and gives it to DSP (38) for the processing of command data signals for making HID lamp (50) ON/OFF, dimming control to set different lamp brightness levels, failure exceptions, to calculate the lamp burning hours sent from the PLCC concentrator.

The TX Amplifier (44) is a discrete interface circuitry, which is electrically connected to the D/A converter (48) and gives the output to the coupling circuit (34) for the transmission of signal. The TX amplifier (44) is a class AB push-pull 2-stage emitter follower amplifier for the amplification of signal to be transmitted combined with an active low-pass filter. The TX amplifier (44) also has a Salen-Key second order filter circuit to remove out of band high frequency energy and provides the voltage gain needed to increase the amplitude of the transmit signal from the level of the D/A converter (48) received signal to the larger amplitude that is used for transmission.

The DSP (38) is a microprocessor with an optimized architecture for the fast operational needs of digital signal processing. The DSP (38) performs following basic functions:

Receives the digital signals from the A/D converter (46) for processing the digital signals sent from the PLCC concentrator.

Sends the response signals to the D/A converter (48) for the digital to analog conversion for the amplification and transmission of the response signals to the PLCC concentrator located in AC power line network.

Receives the analog input signals from the lamp feedback member (54) and process for the failure exceptions, to calculate the HID lamp (50) burning hours and reports all the HID lamp (50) parameters, such as lamp voltage, lamp current, lamp burning hours and failure exceptions, such as fused lamp, ignition failure, warm-up failure, end of lamp life, under lamp voltage, over lamp voltage to send it to the PLCC concentrator disposed on the AC power line network through AC power line thereby enabling remote monitoring of the system and each of the ballast in the network.

Processes the feedback data signal from the temperature sensor (40) to check for high and low temperature, warnings, or exceptions and reports the temperature parameter to the PLCC concentrator.

Receives the feedback signal from the ambient light sensor (56) and based on ambient light conditions the PLCC modem (28) processes the feedback data signal to allow the settings to be automatically adjusted during the twilight conditions.

Generates the 10 KHz, 5V PWM (Pulse width modulation) with duty cycle based on the lamp dimming command signals received from the PLCC concentrator or based on ambient light measured from ambient light sensor (56), and receives the meter reading from energy measurement ASIC module (32).

The D/A converter (48) is electrically connected to the DSP (38) to convert the processed digital signal received from the DSP (38) to analog data and gives it to the TX amplifier (44) for the amplification and transmission of the response signals to the PLCC concentrator located in AC power line network.

The UART (42) is a serial communication device, which receives the meter reading, such as line voltage, line current, Active power (KW), reactive power (KVAR), Apparent power (KVA), Power factor (PF) and total energy unit consumption (Kilowatt hour) from the Energy measurement ASIC module (32) to serial communication interface (GND, TX, RX) and gives it to the DSP (38), which reports back these metering parameters to the PLCC concentrator located in AC power line network through the AC power line.

Further, the ballast includes the temperature sensor (40) for sensing and measuring temperature of the ballast and surrounding thereof, and provide feedback data signal to the PLCC modem (28) to check for high and low temperature alarm conditions to operate the ballast to ON/OFF when the temperature exceeds or less than normal operating temperature conditions and reports the warning to PLCC modem (28) located in AC power line network through AC power line.

The ambient light sensor (56) is connected to the PLCC modem (28). The ambient light sensor (56) is capable of measuring brightness of the ambient light source or available light source in a manner similar to human eye and gives the feedback data signal to the DSP (38) of the PLCC modem (28) to adjusted based on ambient light conditions during the twilight conditions (time between dawn and sunrise, and between sunset and dusk), cloudy conditions, low lux level conditions to ON/OFF the HID lamp by sending HID ON/OFF control signal to the ASIC control card (16), and for dimming the HID lamp (50) to set different brightness levels by sending the 10 KHz PWM signal with variable duty cycle to PWM dimming control (24) of the ASIC control card (16).

Further, the system includes a PLCC concentrator (not shown) connected to the PLCC modem (28) of each of the ballast connected to the respective HID lamps (50) in the power line network. The PLCC concentrator provide reports to a server to enable remote monitoring of the network.

Figure 2:
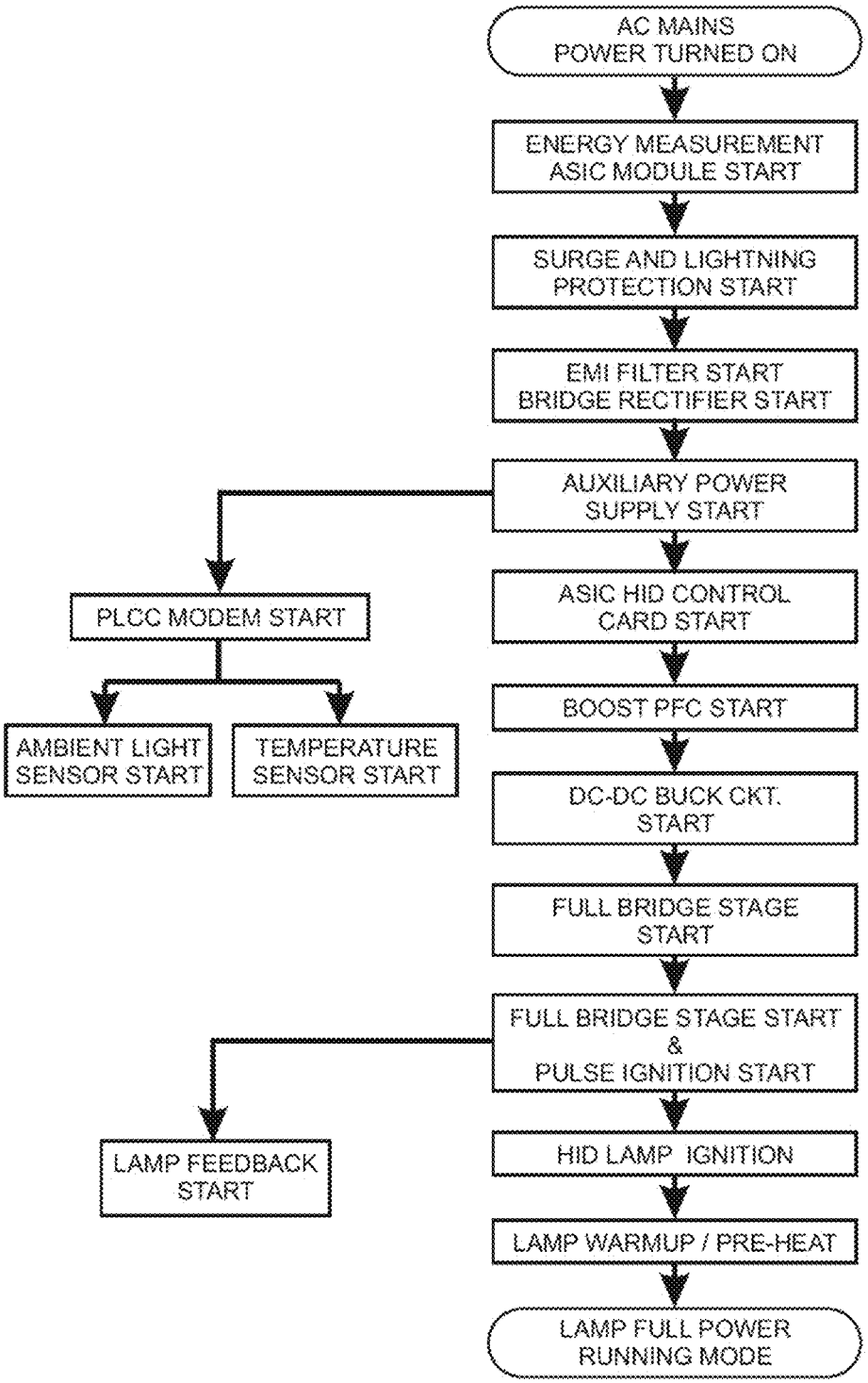
FIG. 2 shows a state diagram of power up sequence of the ballast in accordance with the present invention.

Referring now to FIG. 2, a state diagram of power up sequence of the ballast in accordance with the present invention is illustrated for better understanding of the invention. Initially, AC mains power 90~440 VAC, 50~60 Hz is turned 'ON' which sequentially switches 'ON' (starts) the Energy measurement ASIC module (32) with serial communication the surge and lightning protection circuit (2), the EMI filter (4), the bridge rectifier (6), the auxiliary power supply (30). The auxiliary Power supply (30) in turn switches 'ON' the PLCC modem (28), the ASIC HID control card (16). The PLCC modem (28) in turn switches 'ON' the ambient light sensor (56) and the temperature sensor (40). The ASIC HID control card (16) switches 'ON' the PFC booster (8), the DC-DC buck circuit (10), the full-bridge circuit (12), the lamp feedback member (54) and the SIDAC ignition switch (14). Once the Pulse ignition circuit ON, the HID lamp (50) ignition starts, then goes to the HID lamp warm-up/preheat mode for the maximum duration of 2 minutes and finally goes to the lamp running/burning mode to glow the HID lamp (50) at full power mode.

Figure 3:
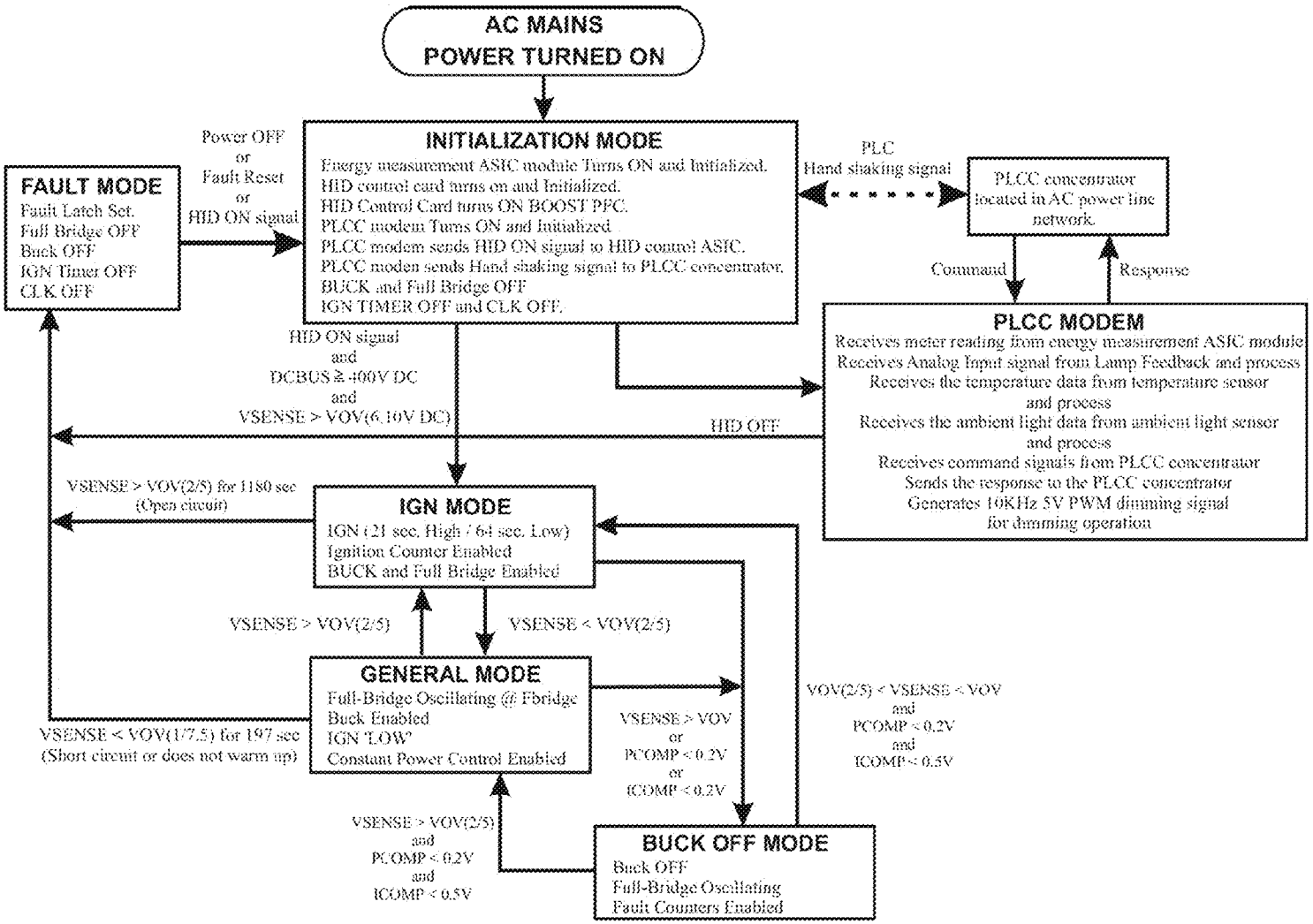
FIG. 3 shows a state and timing diagram of the digital electronic ballast in accordance with the present invention.

Referring now to FIG. 3, a state and timing diagram of said digital electronic ballast in accordance with the present invention is illustrated. After AC mains power is turned ON, initially the ballast enters into hardware initialization mode, where the Energy measurement ASIC module (32) turns 'ON' and gets initialized. Thereafter, the HID control card (16) turns 'ON' and gets initialized. Further, the HID control card (16) turns 'ON' the PFC booster (8), the PLCC modem (28) and is initialized. The PLCC modem (28) sends signals for turning 'ON' the HID lamp (50) to the HID control ASIC (18) and sends the signal to the PLCC concentrator located in AC power line network to register its node ID for the communication, whereas the full-bridge circuit (12) and the DC-DC buck circuit (10) and the ignition timer and clock are turned 'OFF'.

After initialization mode, the HID control ASIC (18) receives signals from the PLCC modem (28) to 'ON' the HID lamp (50) and senses the DC bus voltage and VSENSE from the lamp feedback member (54). If the DC Bus sensed voltage is greater than or equal to 400 VDC and VSENSE is greater than internal reference voltage VOV (which is around 6.10V DC), it enters to IGN (ignition counter) mode.

During the IGN mode, the HID control ASIC (18) enters to lamp ignition phase and the full bridge circuit (12) is enabled. The ignition timer frequency is programmed with the external capacitor, which charges up and down linearly through internal sink and source currents between a fixed voltage window of 2V and 4V. This sets up an internal clock (666 ms typical) that is divided out 128 times and then used to turn the ignition gate driver output connected to the SIDAC ignition switch (14) 'ON' and 'OFF' for a given 'ON' and 'OFF' time (21 sec 'high'/64 sec 'low' typical). Logic 'high' at the IGN pin turns the SIDAC ignition switch (14) 'ON' and enable the SIDAC ignition switch (14). During the ignition phase, the HID lamp (50) is an open circuit and the buck output voltage is limited to a maximum value. The ignition circuit comprises of a SIDAC, a transformer switch (MIGN), a capacitor (CIGN) discharges through a resistor (RIGN). When the voltage across SIDAC reaches the SIDAC threshold voltage, SIDAC turns on and a current pulse flows from the buck output, through the primary winding of the transformer switch (MIGN) and into capacitor (CIGN).

This arrangement generates a high-voltage pulse on the secondary to ignite the lamp. The capacitor (CIGN) charges up until the SIADC turns 'OFF', and capacitor (CIGN) then discharges down through resistor (RIGN0) until the voltage again reaches the ballast's threshold and another ignition pulse occurs. The ignition circuit continuously try to ignite the HID lamp (50) for 21 seconds 'on' and 64 seconds 'off' until the HID lamp (50) ignites. If the HID lamp (50) does not ignite (VSENSE>VOV (2/5)) for 1180 sec, it is open circuit condition and HID control ASIC (18) enters the fault Mode and latch off the Buck, IGN timer. The HID control ASIC (18) exits from the Fault mode on AC power off or fault reset or HID ON signal from PLCC modem. If the HID lamp (50) ignites successfully, the voltage at the VSENSE falls below VOV (2/5) due to the low impedance of the lamp and enters into general mode.

During the general mode the ignition timer is disabled (logic 'low' at the IGN pin) and full bridge starts oscillating at Fbridge. The constant power control loop increases or decreases the buck current for maintaining constant power in the lamp load. During lamp warm-up, the lamp voltage can be very low (20V typical) and the constant power loop attempts to increase the buck current to several amps of current to maintain constant power. This high current can exceed the manufacturer's maximum current rating for the HID lamp (50). To prevent this condition, an additional current limitation control loop has been included in the ASIC should the voltage at the ISENSE pin exceed the voltage level at the OC pin, another OTA sinks current from the ICOMP pin. When the ICOMP pin voltage decreases below the PCOMP pin voltage, then the current limitation loop overrides the constant power loop and the ICOMP pin decreases the buck on-time. The lower of the PCOMP or ICOMP pins overrides the other and control the buck on-time. When the HID lamp (50) eventually warms up and the lamp voltage increases to a level where the HID lamp (50) current is below the maximum allowable limit, then the ICOMP pin voltage increases above the PCOMP pin voltage, and the PCOMP pin controls the buck on-time again for maintaining constant power to the HID lamp (50).

This enters the Buck-OFF Mode if any one of these three conditions occurs:

VSENSE>VOV or

PCOMP<0.2V or

ICOMP<0.2V

When in the Buck-OFF Mode, this goes back to General Mode if all of these three conditions are valid:

VSENSE<VOV (2/5) and

PCOMP>0.2V and

ICOMP>0.5V

This instead, goes back to Ignition Mode if all of these three conditions are valid:

VOV (2/5)<VSENSE<VOV and

PCOMP>0.2V and

ICOMP>0.5V

The HID controls ASIC card (18) reacts to the different load conditions (open-circuit, short circuit, lamp warm-up, constant power running, under-voltage lamp faults, transient under-voltage lamp faults, over-voltage lamp faults, lamp non-strike, etc) by turning the DC-DC buck circuit (10) is 'ON' or 'OFF', for adjusting the DC-DC buck circuit (10) on-time, or counting the occurrence of the different fault conditions and turning the circuit complete off. If the HID lamp (50) does not warm-up or short circuit (VSENSE<VOV (1/7.5)) for 197 seconds, it is open circuit condition and the HID control ASIC (18) enters the fault Mode and latch off the Buck, IGN timer. The HID control ASIC (18) exits from the Fault mode 'ON' and AC power 'OFF' or fault reset or the HID 'ON' signal from the PLCC modem (28).

After the initialization mode, the PLCC modem (28) continuously receives the meter reading such as line voltage, line current, Active power (KW), reactive power (KVAR), Apparent power (KVA), Power factor (PF) and total energy unit consumption (Kilowatt hour) from the energy measurement ASIC module (32) serial UART (42) communication (GND, TX, RX), receives the analog input signals VSENSE and ISENSE from lamp feedback stage and process for the failure exceptions, to calculate the lamp burning hours and reports all the lamp parameters such as lamp voltage, lamp current, lamp burning hours and failure exceptions such as fused lamp, ignition failure, warm-up failure, end of lamp life, under lamp voltage, over lamp voltage.

Receives the temperature data signal from temperature sensor to check for high and low temperature alarm conditions, warnings or exceptions, receives the ambient light data from ambient light sensor and process, Receives the command signals from PLCC concentrator and reports back these metering parameters to the PLCC concentrator located in AC power line network through AC power line media. Generates 10 KHz, 5V PWM dimming signal for the dimming operation.

The ballast of the present invention is capable of controlling and regulating the flow of electric current to high intensity discharge lamp for a High Pressure Sodium (HPS) type or Metal Halide (MH) type or Ceramic metal halide (CMH) type lighting system. The ballast does not have reactive KVAR losses and consumes very less energy with the system efficiency of 95%. For example with 250 Watts HPS/MH/CMH lighting system draws 250 Watts for the HID lamp plus 45 watts as a ballast loss for the total of 295 watts which has an efficiency (250/295)=84.75%. It has been empirically determined that lighting system with digital electronic ballast described herein draws total of 263 watts and also produce 25% more lumen light output compared to electromagnetic ballast thereby saving considerably 15% to 20% amount of energy. The ballast operates the HID lamp (50) at lower frequency square wave in the few 100 Hz range (100 Hz to 800 Hz) to produce 25% more lumen light output and also avoids acoustic resonance problems. Thus the end result is a system which is highly efficient. Also as described above the ballast has the ability to dim to any light level desired and more energy savings can be experienced as a normal reduction in light of 20% is not generally perceptible by human eye.

The foregoing descriptions of specific embodiments of the present invention has been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, to thereby enable others skilled in the art to best utilize the present invention and various embodiments with various modifications as are suited to the particular use contemplated. It is understood that various omission and substitutions of equivalents are contemplated as circumstance may suggest or render expedient, but such are intended to cover the application or implementation without departing from the spirit or scope of the claims of the present invention.

We claim:

1. A system for monitoring and controlling a high intensity discharge (HID) lamps, the system comprising:

a digital electronic ballast for monitoring and controlling each of the HID lamp, the digital electronic ballast comprising, an energy measuring Application-Specific Integrated Circuit (ASIC) module receiving electricity from a power source, wherein the energy measuring ASIC module means is configured to measure electricity line voltage, current, active power, reactive power, apparent power, power factor (PF) and total power unit consumption of the digital electronic ballast and the HID lamp connected thereto, a fuse electrically connected to a neutral output of the energy measuring ASIC module, the fuse breaks the electricity supply during short circuit, overload and device failure thereby protects the digital electronic ballast from damaging, a surge and lightning protection circuit electrically connected to energy measuring ASIC module through the fuse there between, the surge and lightning protection circuit provides protection from high voltage line surges, inrush current and lightning strikes, an Electromagnetic interference (EMI) filter electrically connected to the surge and lightning protection circuit, the EMI filter filters noise generated by the digital electronic ballast from transmitting reverse back on to an electricity supply lines, filters out harmonics for an incoming ranging from 90 to 440 volts having alternating current of 50 to 60 hertz cycle and acts as high impedance path to attenuate the high frequency signal, and reduces strength of the signal thereby reducing adverse effect on the digital electronic ballast, a full wave bridge rectifier electrically connected to the EMI filter, the full wave bridge rectifier converts electricity having alternating current (AC) received from the EMI filter to direct current (DC) thereby providing high voltage bus power, the converted DC output from the full wave bridge rectifier is provided to reservoir filter capacitor or smoothing capacitor to reduce the variation in or smooth the rectified AC output voltage waveform from the full wave bridge rectifier, a power factor correction (PFC) booster electrically connected to the full wave bridge rectifier, the PFC booster boosts the voltage received from the full wave bridge rectifier and maintains a sinusoidal current that is in phase with AC supply line input to attain the high power factor and low harmonic distortion and regulates constant DC bus voltage ranging from 400 VDC to 650 VDC electricity even when the incoming AC electricity fluctuates anywhere between 90 VAC to 440 VAC, where the PFC booster circuit is bypassed at Vbus>Vin*sqrt(2) and operates over entire high voltage range till 440 VAC input voltage without any cut-off, wherein Vbus is DC bus voltage, Vin is AC supply voltage;

a DC-DC buck circuit electrically connected to the PFC booster, the DC-DC buck circuit receives the constant DC bus voltage from the PFC booster, wherein the DC-DC buck circuit controls the amount of current delivers to the HID lamp while warming up and during running state, a full-bridge circuit with a Silicon diode for Alternating Current (SIDAC) ignition switch electrically connected to the DC-DC buck circuit, wherein the full-bridge circuit enables driving of the HID lamp with a low frequency square wave voltage and the SIDAC ignition switch enables the striking of the HID lamp connected thereof, a lamp feedback member is electrically connected to the full-bridge circuit, the lamp feedback member senses the HID lamp voltage and current, and provide the feedback signals thereof for sensing HID lamp characteristics, and controlling working thereof, the lamp feedback member comprises an ISENSE for current sense, which senses the lamp current signals and a VSENSE for voltage sense which senses the lamp voltage signals, an application-Specific Integrated Circuit (ASIC) control card connected to the PFC booster, the DC-DC buck circuit, the full-bridge circuit and the SIDAC ignition switch, wherein the ASIC control card receives feedback signals from the HID lamp feedback member thereafter controls the operation of the PFC booster, the DC-DC buck circuit, the full-bridge circuit and the SIDAC ignition switch depending upon surrounding environmental parameters and characteristics sensed around the HID lamp thereby the ASIC control card controls working of the HID lamp, an auxiliary power supply electrically connected to an output of the PFC booster, the auxiliary power supply receives the constant DC bus voltage of about 600 to 700 VDC from the PFC booster and converts into low voltage DC bus in the range of 15 to 20 VDC to give the supply voltage to power up the ASIC control card, a Power-line Carrier Communication (PLCC) modem electrically connected between the surge and lightning protection circuit, the EMI filter and the energy measuring ASIC module for remote monitoring and control operation of the HID lamp, wherein the PLCC modem receives measuring line voltage, line current, active power, reactive power, apparent power, power factor and total power unit consumption of the HID lamp from the energy measuring ASIC module, a temperature sensor for sensing and measuring temperature of the digital electronic ballast and surrounding thereof, and provide feedback data signal to the PLCC modem to check for high and low temperature alarm conditions to operate the digital electronic ballast to ON/OFF when the temperature exceeds or less than normal operating temperature conditions, and an ambient light sensor connected to the PLCC mode, the ambient light sensor configured to measure brightness of the ambient light source or available light source in a manner similar to human eye and gives the feedback data signal to the PLCC modem to adjust based on ambient light conditions during the twilight conditions (time between dawn and sunrise, and between sunset and dusk), cloudy conditions, low lux level conditions to ON/OFF the HID lamp by sending HID ON/OFF control signal to the ASIC control card, and for dimming the HID lamp to set different brightness levels by sending a 10 KHz Pulse width modulation (PWM) signal with variable duty cycle to the ASIC control card; and a PLCC concentrator is located in AC Power line network and connected to the PLCC modem of each of the digital electronic ballast connected to the respective HID lamps in the AC power line network, the PLCC concentrator sends the command signals such as lamp ON/OFF, lamp dimming, lamp scheduling rules to the PLCC modem, also receives lamp status, real time electric parameters, failure information, end of lamp life (EOLL) or lamp burning hours, temperature conditions and warning from the PLLC modem thereby the PLCC concentrator provide reports to a server to enable remote monitoring of the AC power line network.

2. The digital electronic ballast as claimed in claim 1, wherein the ASIC control card comprises:

a PFC controller ASIC electrically connected to the PFC booster, wherein the PFC controller controls the PFC booster to operate either in fixed frequency average current mode PWM or the transition mode PWM—fixed ON time, variable frequency to maintain the high power factor, low harmonic distortion, constant lamp output voltage even when incoming AC power source fluctuate anywhere between 90~440 VAC, to power up the PFC controller ASIC receives the 15 VDC supply voltage from auxiliary power supply;

a HID controller ASIC is electrically connected to the DC-DC buck circuit, provides the control signals to the full-bridge circuit, the SIDAC ignition switch based on feedback signals from the lamp feedback member and controls the HID lamp ignition, warm-up, running and all fault modes, further, the HID controller ASIC controls the DC-DC buck circuit to operate depending on changing load conditions on the HID Lamp, furthermore, the HID controller ASIC receives the signals from lamp feedback member to control the buck on-time to keep the multiplier output equal to an internal reference voltage and thereby regulate the HID lamp power to a constant level;

an autosensing lamp circuitry provides feedback to the HID controller ASIC, the autosensing lamp circuitry is an analog comparator logic circuitry electrically connected to the lamp feedback member which senses the different characteristics (current and voltage) the HID lamp and gives the feedback input to the HID control ASIC to operate the HID lamp accordingly; and a PWM dimming controller provides feedback to the HID controller ASIC, the PWM dimming controller is an analog circuit electrically connected to the ISENSE of the lamp feedback member and receives the 10 Khz, 5V PWM input signal based on the HID lamp dimming command signals received from the PLCC module and based en ambient light measured from the ambient light sensor and the PWM dimming controller adds the DC offset to the ISENSE input of the HID control ASIC to control the brightness of the HID lamp to set the lamp brightness levels from 1-100% thereby saving considerably amount of energy.

3. A digital electronic ballast as claimed in claim 1, wherein the PLCC modem comprises:

a coupling circuit which is electrically connected to between the surge and lightning protector and the EMI filter which attenuates the input AC signal in the range of 50 Hz to 60 Hz, which provides a coupling between the power line of the digital electronic ballast and the PLCC modem, and provides a high-pass filter for receiving and transmitting the signal and attenuates the signal of frequency lower than its cut-off frequency;

a coupling capacitor and an inductor/transformer, together provides a high-pass filter for receiving and transmitting the signal and attenuates the signal of frequency lower than a pre-defined cut-off frequency;

a Receiver (Rx) front end electrically connected to the coupling circuit to provide a filtered analog output, wherein the Receiver (Rx) front end is a discrete interface circuitry;

an Analog to Digital (A/D) converter electrically connected to the RX front end and converts the filtered analog output received from the RX front end to digital data;

a digital signal processing (DSP) electrically connected to the A/D converter and receives the digital data from the A/D converter for the processing of command data signals for operating the HID lamp to ON/OFF, dimming control to set different lamp brightness levels, failure exceptions, to calculate the lamp burning hours;

a Digital to Analog (D/A) converter electrically connected to the DSP to convert the processed digital signal received from the DSP to analog data;

a Transmitter (TX) Amplifier is electrically connected to the D/A converter for amplification and transmission of the response signals to the PLCC concentrator located in AC power line network; and an UART (Universal Asynchronous Receiver Transmitter) with serial communication interface (GND, TX, RX) connected to the DSP, wherein the PLCC modem receives command signals such as lamp ON/OFF, dimming, lamp status, scheduling rules, real time electric parameters, failure information's, end of lamp life (EOLL) or lamp burning hours from the PLCC concentrator located in AC power line network through AC power line thereafter the PLCC modem processes the received command signals by sensing the feedback signals from the lamp feedback member, the temperature sensor, the ambient light sensor and provides the control signals to the ASIC HID control card for making the HID lamp ON/OFF, and the PWM dimming control to set different lamp brightness levels and receiving a reading from the Energy measurement ASIC module serial UART communication (GND, TX, RX) and sends the response back to the PLCC concentrator.

* * * * *